US009663204B2

(12) United States Patent
Kuroda

(10) Patent No.: US 9,663,204 B2
(45) Date of Patent: May 30, 2017

(54) SWIMMING MASK

(71) Applicant: TABATA CO., LTD., Tokyo (JP)

(72) Inventor: Yuji Kuroda, Tokyo (JP)

(73) Assignee: TABATA CO., LTD., Tokyo (JP)

( * ) Notice: Subject to any disclaimer, the term of this patent is extended or adjusted under 35 U.S.C. 154(b) by 876 days.

(21) Appl. No.: 13/657,133

(22) Filed: Oct. 22, 2012

(65) Prior Publication Data

US 2013/0111655 A1 May 9, 2013

(30) Foreign Application Priority Data

Nov. 7, 2011 (JP) ..... 2011-244016

(51) Int. Cl.
*B63C 11/12* (2006.01)

(52) U.S. Cl.
CPC ..... *B63C 11/12* (2013.01)

(58) Field of Classification Search
CPC ..... B63C 11/12; B63C 2011/126; A61F 9/02; A61F 9/026; A63B 33/002
USPC ..... 2/431, 426, 428, 9
See application file for complete search history.

(56) References Cited

U.S. PATENT DOCUMENTS 2,881,444 A * 4/1959 Fresh ..... A61F 9/026 2/428
4,689,837 A * 9/1987 Bolle ..... A62B 18/08 2/428
5,771,499 A * 6/1998 Monaco ..... A61F 9/026 2/428
6,138,281 A * 10/2000 Chiaruttini ..... A41B 11/00 2/239
6,272,693 B1 * 8/2001 Godoy ..... B63C 11/12 2/430
6,505,353 B2 * 1/2003 Sung ..... A63B 33/002 2/428
6,921,165 B1 * 7/2005 Feng ..... A63B 33/002 2/428
6,966,068 B2 * 11/2005 Johnson ..... A63B 33/00 2/200.2
7,080,415 B2 * 7/2006 Wiedner ..... A61F 9/026 2/435
7,181,778 B1 * 2/2007 Garraffa ..... A61F 9/025 2/426
7,451,498 B2 * 11/2008 Kuroda ..... B63C 11/12 2/428

(Continued)

FOREIGN PATENT DOCUMENTS

JP 2003-265647 9/2003
TW EP 2423099 A2 * 2/2012 ..... A63B 33/002

*Primary Examiner* — Alissa L Hoey
(74) *Attorney, Agent, or Firm* — Clark & Brody

(57) ABSTRACT

A swimming mask including an elastic skirt of which a rear peripheral region is partially provided with regions having an elastic stretchability higher than that of the remaining regions to ensure the elastic skirt to be kept in close contact with the wearer's facial surface. A rear peripheral portion 19 of an elastic skirt 13 includes an upper covering region 25, a lower covering region 26 and lateral covering regions 27, 28 wherein at least one of the upper covering region 25 and the lateral covering regions 27, 28 is formed with a pair of high elastically stretchable regions 31, 32, 33, 34 adapted to be more easily elastically stretched and contracted in a circumferential direction than a remaining region in the rear peripheral portion 19.

7 Claims, 10 Drawing Sheets

(56) References Cited

U.S. PATENT DOCUMENTS

| | | | | |
|---|---|---|---|---|
| 7,862,401 | B2 * | 1/2011 | Watrin | A41C 3/0014 450/39 |
| 2003/0074718 | A1 * | 4/2003 | English | A41B 11/004 2/239 |
| 2003/0221246 | A1 * | 12/2003 | Schary | A61F 9/027 2/453 |
| 2004/0117898 | A1 * | 6/2004 | Penque, Jr. | A61F 9/028 2/431 |
| 2005/0210568 | A1 * | 9/2005 | Sheldon | A61F 9/025 2/426 |
| 2006/0107446 | A1 * | 5/2006 | Shiue | B63C 11/12 2/428 |
| 2006/0117469 | A1 * | 6/2006 | Garofalo | B63C 11/12 2/428 |
| 2007/0130675 | A1 * | 6/2007 | Sheldon | A61F 9/027 2/448 |
| 2008/0072365 | A1 * | 3/2008 | Alberto | B63C 11/12 2/428 |
| 2008/0120767 | A1 * | 5/2008 | Garofalo | B63C 11/12 2/428 |
| 2008/0196714 | A1 * | 8/2008 | Shiue | B63C 11/12 128/201.27 |
| 2008/0301858 | A1 * | 12/2008 | Wang-Lee | A61F 9/025 2/436 |
| 2009/0165191 | A1 * | 7/2009 | Kuroda | B63C 11/12 2/428 |
| 2009/0217444 | A1 * | 9/2009 | Pan | B63C 11/12 2/428 |
| 2010/0064421 | A1 * | 3/2010 | Wang-Lee | A61F 9/025 2/428 |
| 2012/0047615 | A1 * | 3/2012 | Shiue | A63B 33/002 2/9 |

* cited by examiner

SWIMMING MASK

BACKGROUND OF THE INVENTION

The present invention relates to swimming masks used for various purposes such as diving and particularly to swimming masks having an elastic skirt adapted to be kept in close contact with a wearer's facial surface with an improved fit.

Conventionally, swimming masks used for various purposes such as diving are widely known. For example, JP2003-265647A discloses a swimming mask including a lens frame holding a pair of lenses, an elastic skirt extending backward from the lens frame, a pair of buckles provided on both sides of the lens frame and a head strap arranged so as to be turned around in the respective buckles.

SUMMARY OF THE INVENTION

In the swimming mask disclosed in JP2003-265647A, an effective length of the head strap may be adjusted depending on an individual wearer and put about the wearer's head to ensure that the elastic skirt is kept in close contact with the wearer's facial surface.

However, the elastic skirt is made of a relatively soft elastic member and it is also required to have a predetermined strength and, as a result, the elastic skirt as a whole has a relatively large thickness and a relatively high stiffness to meet the required strength. Under such condition, it is difficult for the elastic skirt to be kept in close contact with protruding regions of the wearer's facial surface, and a gap between the elastic skirt and the wearer's facial surface might be created which allows water to flow into the mask. In addition, there is a likelihood that the wearer's skin may be pulled rearward together with the elastic skirt and uncomfortably irritated in putting on the mask.

An object of the present invention is to improve the conventional swimming mask so that a rear peripheral region of an elastic skirt formed of elastic material such as rubber is partially provided with regions having an elastic stretchability higher than that of the remaining regions to ensure the elastic skirt to be kept in close contact with the wearer's facial surface.

Some embodiments of the present invention provide a swimming mask having a vertical direction, a transverse direction, and a front-back direction to the transverse direction, and including a mask chassis and a head strap. The mask chassis includes lenses, a lens frame and an elastic skirt formed of soft elastic material and extending rearward from a periphery of the lens frame and having a rear peripheral portion adapted to be kept in contact with a facial surface of a wearer. The head strap includes opposite distal ends connected to respective connector portions provided on both sides of the mask chassis.

The swimming mask according to the present invention further includes the following features:

the rear peripheral portion of the elastic skirt includes an upper covering region, a lower covering region spaced apart from and opposite to the upper covering region in the vertical direction and lateral covering regions spaced apart from and opposite to each other in the transverse direction; and at least one of the upper covering region and the lateral covering regions is formed with high elastically stretchable regions adapted to be more easily stretched in a circumferential direction of the rear peripheral portion than a remaining region of the rear peripheral portion.

According to one embodiment of the present invention, the high elastically stretchable regions includes a plurality of depressions spaced apart from each other in the circumferential direction and extending in the front-back direction and a plurality of distance spaces, each being defined between each of the depressions adjacent to each other.

According to another embodiment of the present invention, the swimming mask further includes a first high elastically stretchable region and a second high elastically stretchable region spaced apart from and opposite to each other in the transverse direction, a third high elastically stretchable region and a fourth high elastically stretchable region located in the lateral covering regions.

According to even another embodiment of the present invention, the elastic skirt further has a vertical center line bisecting a length dimension in the transverse direction of the elastic skirt, and the first and second high elastically stretchable regions respectively lie between the vertical center line and the connector portions of the mask chassis in the upper covering region, and the third and fourth high elastically stretchable regions respectively lie below the connector portions in the lateral covering regions.

According to still another embodiment of the present invention, the swimming mask further include a fifth high elastically stretchable region lying in a midsection of the lower covering region and having, as a whole, a thickness smaller than that of a remaining portion in the lower covering region.

According to yet another embodiment of the present invention, protrusions for stability of the elastic skirt are formed between the third and the fourth high elastically stretchable regions and the fifth high elastically stretchable region, respectively.

According to a further embodiment of the present invention, each of the outer ends of the depressions forming the high elastically stretchable regions lie inboard of the outer side edge of the rear peripheral portion.

According to an even further embodiment of the present invention, the depressions forming the high elastically stretchable regions are arranged so as to be spaced apart from each other by a predetermined dimension in the circumferential direction and the front-back direction of the rear peripheral portion.

According to a still further embodiment of the present invention, the respective high elastically stretchable regions have width dimensions gradually enlarged rearward.

According to a yet further embodiment of the present invention, at least the high elastically stretchable regions in the rear peripheral portion are coated on inner surfaces thereof with cosmetically acceptable coating agent functioning to improve a slidability relative to the wearer's skin.

In one or more embodiments of the swimming mask according to the present invention, the rear peripheral portion of the elastic skirt is formed at least in the upper covering region or the lateral covering regions with the high elastically stretchable regions. In this way, the high elastically stretchable regions elastically stretch and/or contract along the protruding regions in the wearer's facial configuration and thereby the fit of the rear peripheral portion is further improved. Consequently, water should not flow into the swimming mask through the gap which would otherwise be developed between the rear peripheral portion and the wearer's facial surface and also an uncomfortable irritation to the wearer's skin during use of the swimming mask can be alleviated.

DESCRIPTION OF THE EMBODIMENTS

Figure 1:
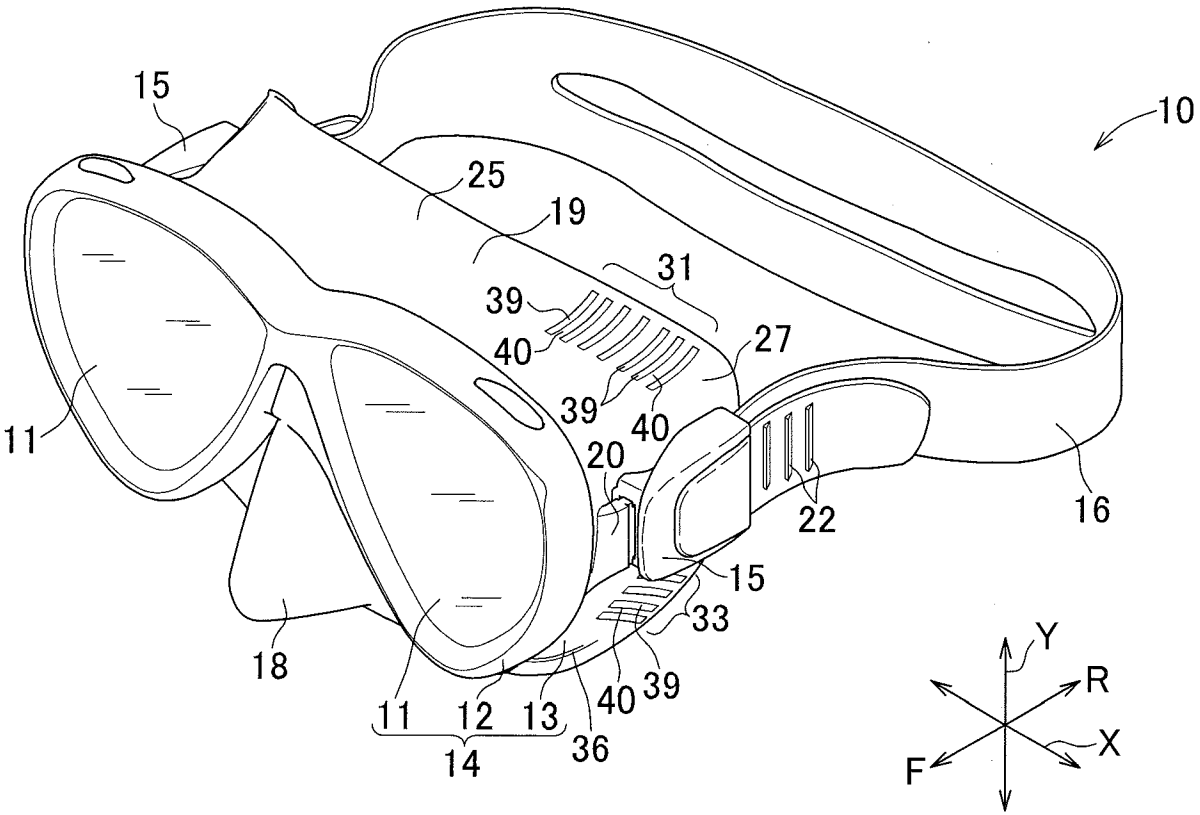
FIG. 1 is a perspective view of swimming mask according to the present invention.

Referring to FIG. 1, a swimming mask 10 has a vertical direction Y, a transverse direction X being orthogonal to the vertical direction Y and a front-back direction F-R being orthogonal to both the vertical direction Y and the transverse direction X. The swimming mask 10 includes: a mask chassis 14 including a lens frame 12 holding lenses 11 and an elastic skirt 13 formed of a soft elastic material such as synthetic rubbers or plastics and extending rearward from the lens frame 12; buckles 15 provided on both sides of the lens frame 12; and a head strap 16 having opposite distal ends arranged to be turned around the respective buckles 15 so that an effective length of the head strap 16 may be adjusted.

Each of the lenses 11 is formed of a hard transparent plate made of one of inorganic material such as glass and organic material such as plastics. The elastic skirt 13 includes a nose covering portion 18 defined in a middle in the transverse direction X of the lens frame 12, i.e., between the respective lens holding frames and protruding in a frontward direction F and an annular rear peripheral portion 19 adapted to be put in contact with the wearer's facial surface. On both sides of the elastic skirt 13, connector portions 20 are formed integrally with the rear peripheral portion 19 so that the respective buckles 15 may be connected to the elastic skirt 13 by the intermediary of the respective connector portions 20. The buckles 15 are formed of a hard plastic material similar to the material for the lens frame 12 and the head strap 16 is made of a soft elastic material which is similar to or much softer than the material for the elastic skirt 13. The head strap 16 is provided on its inner surface with a plurality of stopper teeth 22 arranged at regular intervals in the length direction thereof.

Figure 2:
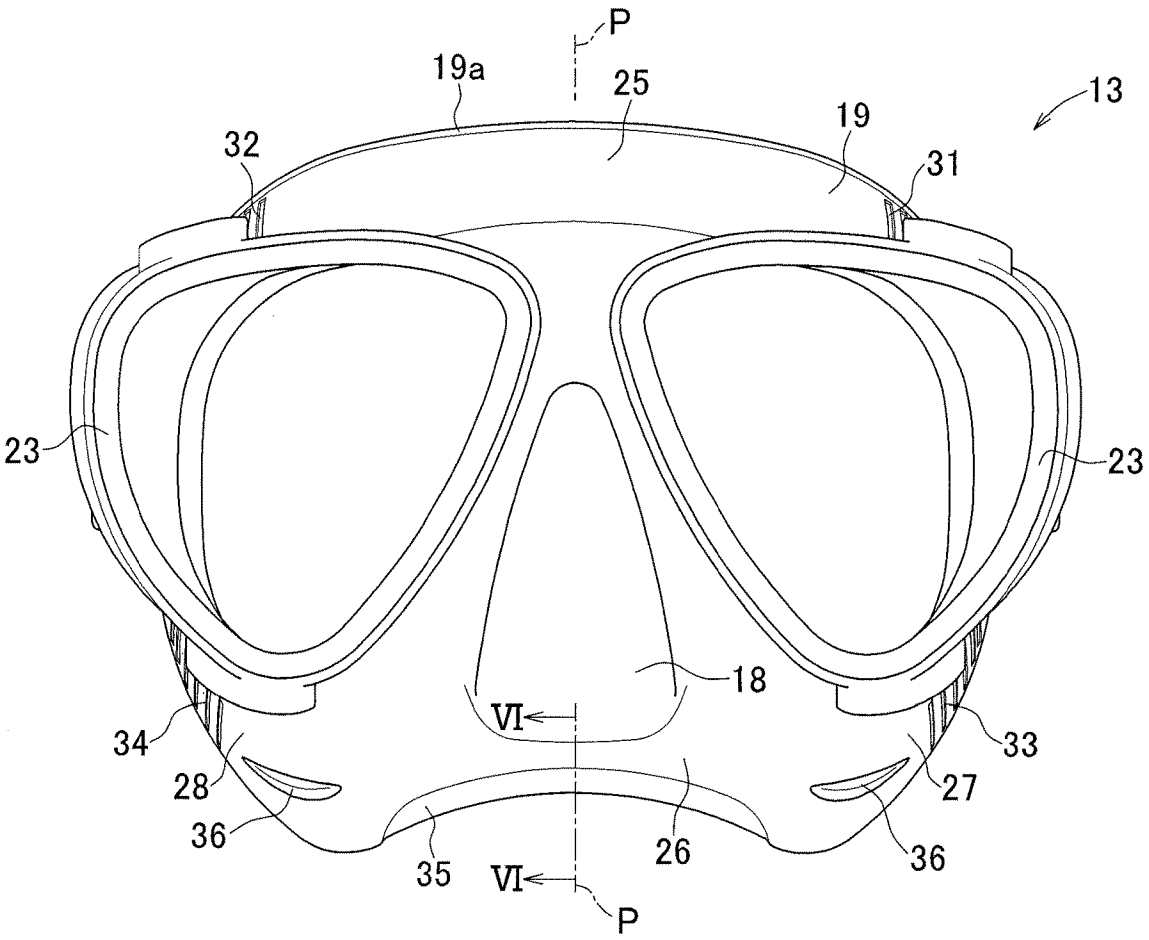
FIG. 2 is a front elevational view of an elastic skirt.

Referring to FIG. 2, the elastic skirt 13 has a vertical center line P-P bisecting its dimension in the transverse direction X and is symmetric about this vertical center line P-P. The elastic skirt 13 has a pair of openings 23 in which the lens frame 12 is fitted. The rear peripheral portion 19 of the elastic skirt 13 includes an upper covering region 25 extending in a rearward direction R from the middle section of the lens frame 12, a lower covering region 26 underlying the nose covering portion 18 and extending in the transverse direction X and lateral covering regions 27, 28 lying in vicinities of the respective connector portions 20 and spaced apart from and opposed to each other in the transverse direction X.

Figure 3:
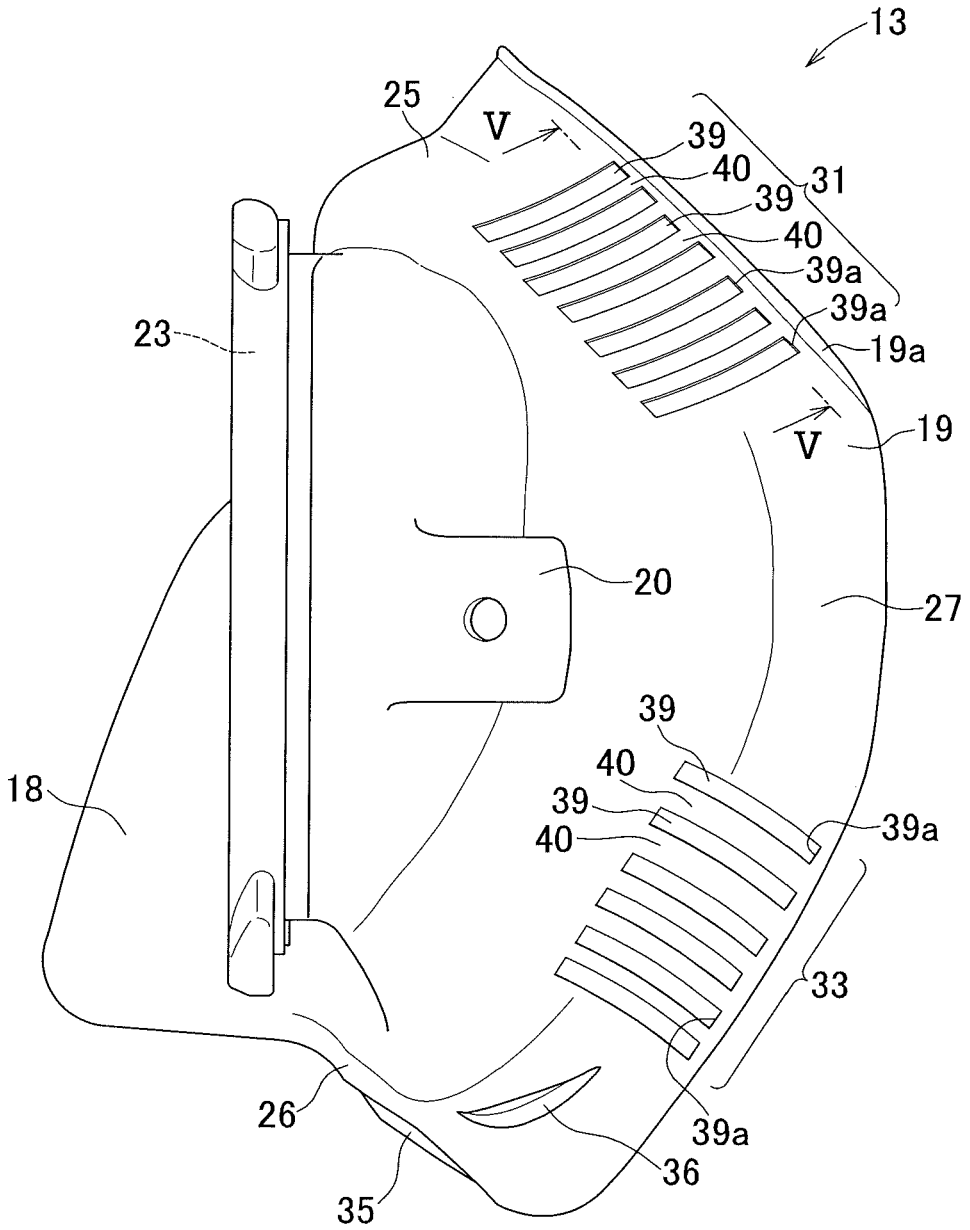
FIG. 3 is a right side view of the elastic skirt.
Figure 4:
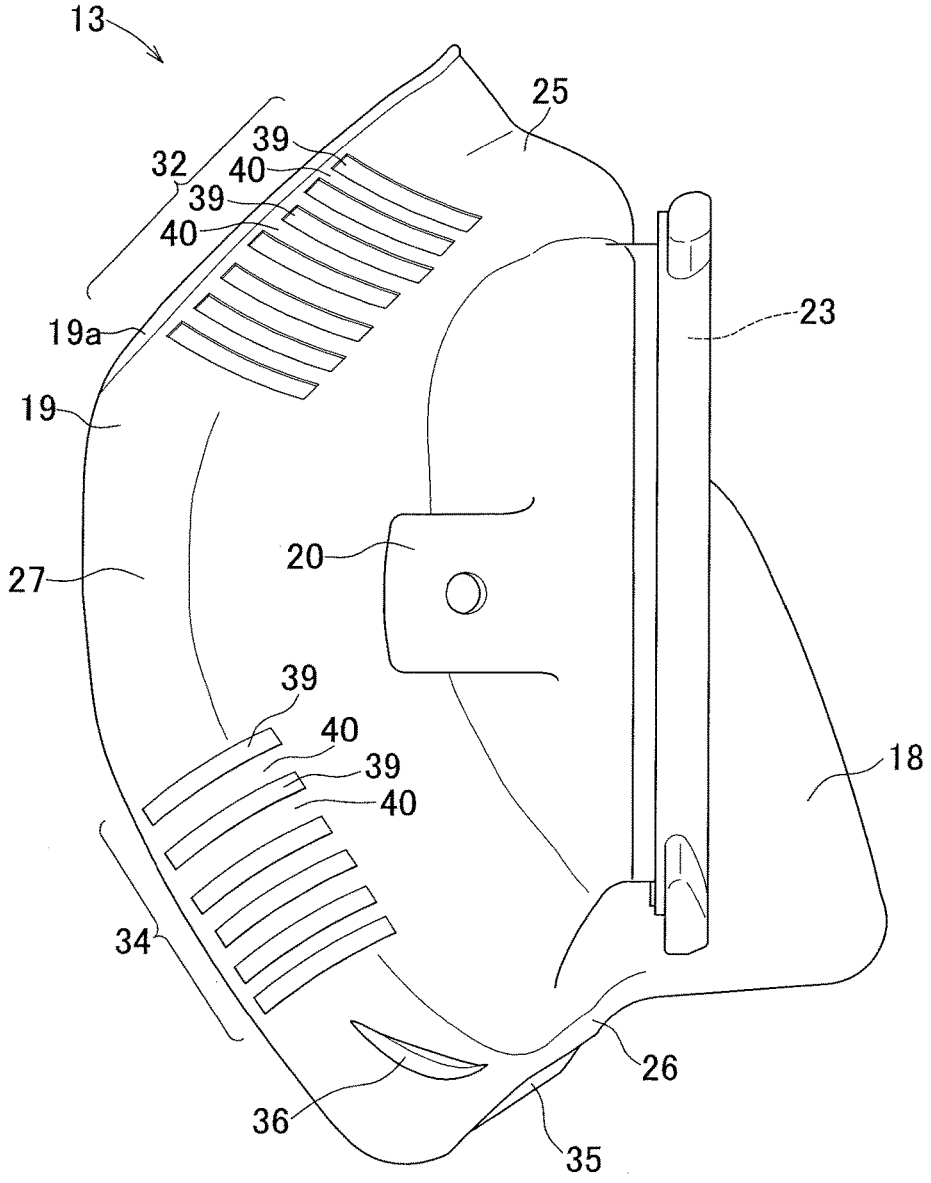
FIG. 4 is a left side view of the elastic skirt.

Referring to FIGS. 3 and 4, the rear peripheral portion 19 includes a plurality of high elastically stretchable regions, specifically, first and second high elastically stretchable regions 31, 32 spaced apart from and opposed to each other in the transverse direction X in the upper covering region 25, third and fourth high elastically stretchable regions 33, 34 extending below the connector portions 20 of the mask chassis 14, respectively, and a fifth high elastically stretchable region 35 lying in the middle of the lower covering region 26. Between the third high elastically stretchable region 33 and the fifth high elastically stretchable region 35 and between the fourth high elastically stretchable region and the fifth high elastically stretchable region 35, respective protrusions 36 are formed so as to protrude from the outer surface of the elastic skirt 13. In consideration of the fact that the swimming mask 10 is symmetric about the vertical center line P-P as has previously been described, the first and third high elastically stretchable regions 31, 33 lying on the right lateral side of the elastic skirt 13 will be described below with reference to FIG. 3.

Figure 5:
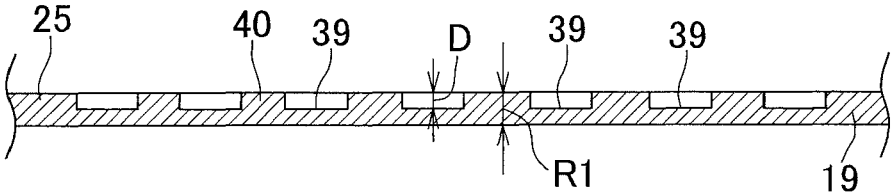
FIG. 5 is a sectional view taken along line V-V in FIG. 3.

Referring to FIGS. 3 and 5, both the first and third high elastically stretchable regions 31, 33 have a plurality of depressions 39 arranged in a circumferential direction of the rear peripheral portion 19 and extending in a direction intersecting the rear peripheral portion 19, and flat portions 40 are defined between the depressions 39 adjacent to each other. As illustrated in FIG. 3, the depressions 39 in the first high elastically stretchable region 31 are thinner than the remaining portion of the elastic skirt 13 inclusive of the respective flat portions 40. Specifically, a thickness dimension R1 of the rear peripheral portion 19 is in a range of about 1.0 to about 2.0 mm and a depth dimension D of the depressions 39 is in a range of about 0.4 to about 1.2 mm. Consequently, in putting the swimming mask on the wearer's facial surface and pulling the elastic skirt 13 in the circumferential direction of the rear peripheral portion 19, the depressions 39 thinner than the remaining portion are stretched in the circumferential direction of the rear peripheral portion 19 over a wider range than the remaining portion. In this way, the first high elastically stretchable region 31 as a whole is more elastically stretchable and contractible than remaining portions.

While the first and third high elastically stretchable regions 31, 33 may be continuously made thinner than the remaining region of the rear peripheral portion 19, respectively, to facilitate elastic stretch and contraction thereof in the circumferential direction. In this regard, in the present invention, a plurality of the depressions 39 and the flat portions 40 are configured to be alternated in the circumferential direction of the rear peripheral portion 19 to facilitate elastic stretch and contraction of these regions 31, 33 conforming to a geometry of the wearer's facial surface and to ensure that these regions 31, 33 having a partially appropriate stiffness are stably kept in close contact with the wearer's facial surface without the first and third high elastically stretchable regions spacing away from the wearer's facial surface under water. In addition, degrees of the elastically stretchable of the first and third high elastically stretchable regions 31, 33 may be appropriately adjusted by appropriately selecting the thickness dimension, configuration and size of the depression 39 and the flat portion 40. While the rear peripheral portion 19 is provided in its upper covering region 25 with the first and second high elastically stretchable regions 31, 32 and in the lateral covering regions 27, 28 with the third and fourth high elastically stretchable regions 33, 34, respectively, in order to further improve the fit of the elastic skirt 13 to the wearer's facial surface according to the present embodiment, at least only the first and second high elastically stretchable regions 31, 32 or only the third and fourth high elastically stretchable regions 33, 34 may be provided so long as the above-mentioned effect can be achieved.

The term "high elastically stretchable regions" used herein means the regions of the elastic skirt 13 formed of one and same soft elastic material which are continually made thinner than the remaining region so as to have the elastic stretchability and contractility higher than those in the remaining region. More specifically, a stretch percentage (percentage of length change) obtained when the region of the rear peripheral portion 19 other than the respective high elastically stretchable regions is pulled in the circumferential direction by a predetermined force is in a range of about 1.0 to about 4.0%. In contrast, a stretch percentage (percentage of length change) obtained when the first through fourth high elastically stretchable regions 31, 32, 33, 34 are pulled in the circumferential direction by the predetermined force is in a range of about 5.0 to about 8.0%. Such degree of stretch percentage is relatively small but sufficient to ensure that the elastic skirt 13 is elastically stretched and contracted conforming to the wearer's facial surface's configuration and kept in close contact with the wearer's facial surface.

<Measuring Method for Stretch Percentage of the Respective High Elastically Stretchable Regions>

The stretch percentages of the respective high elastically stretchable regions were measured by a method as will be described below with use of Tensile-Compressive Testing Machine (manufactured by Showa Testing Machine Mfg., Ltd. in Japan). For the respective high elastically stretchable regions, pieces having a width dimension (a dimension in the radial direction of the rear peripheral portion 19) of 10 mm and a length dimension (a dimension in the circumferential direction) of 45 mm were cut off as respective test pieces. the length dimension of 45 mm in each of the test pieces was pulled at a load/10 mm width of 14.7 N (a tensile force in the circumferential direction of the rear peripheral portion assumed when the swimming mask were put on the wearer's facial surface) and a length of the test piece after having pulled is designated here by A (mm). A stretch percentage was obtained by calculation "(A−45)/45×100", i.e., (a length of the test piece after having been stretched by the force of 14.7N−a length of the test piece before having been stretched)/(a length of the test piece before having been stretched)×100. A plurality of times (N=3) of measurements were conducted on the respective high elastically stretchable regions and respective averages were obtained as the stretch percentages (%). The stretch percentage of the region in the rear peripheral portion 19 other than the respective high elastically stretchable regions was also measured by the same method.

As illustrated in FIG. 3, respective outer ends 39*a* of the depressions 39 are located inboard of an outer side edge 19*a* of the rear peripheral portion 19 as viewed in a direction intersecting therewith. As a result, even when the high elastically stretchable regions 31, 33 are pulled in the circumferential direction of the rear peripheral portion 19 and the depressions 39 become further thinner than before the swimming mask 10 are put on the wearer, the outer ends 39*a* of the depressions 39 should not be partially torn or cracked. While each of the depressions 39 has a substantially rectangular shape which is relatively long in the direction intersecting the rear peripheral portion 19 so far as the present embodiment is concerned, it is also possible to configure the depression 39 to gradually spread out in a fan-like form toward its outer end. In such case, the elastic stretchability of the first and third high elastically stretchable regions 31, 33 is enhanced in vicinities of the respective outer ends thereof so as to be kept in further close contact with the wearer's body and it is ensured that water should not flow into the swimming mask.

Figure 6:
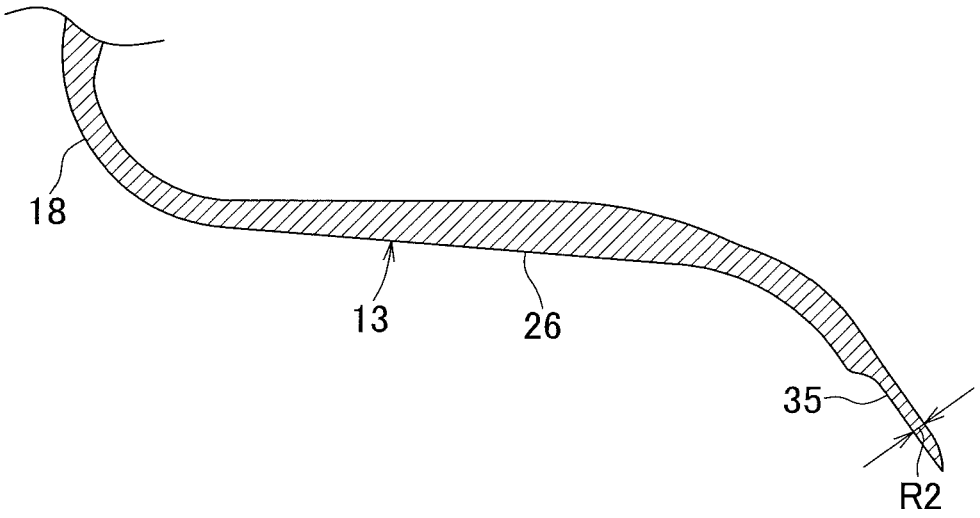
FIG. 6 is a sectional view taken along line VI-VI in FIG. 2.

Referring to FIG. 6, the fifth high elastically stretchable region 35 as a whole is thinner than the remaining region of the elastic skirt 13. Specifically, a thickness dimension R2 of the fifth high elastically stretchable region 35 is in a range of about 0.4 to about 1.2 mm. Therefore, the fifth high elastically stretchable region 35 stretches more smoothly than the first through fourth high elastically stretchable regions 31, 32, 33, 34. Specifically, the elastic stretchability (percentage of length change) of this fifth high elastically stretchable region 35 measured by the aforementioned method, i.e., after this region 35 has been pulled in the circumferential direction of the rear peripheral portion 19 under a predetermined tensile force is in a range of about 5.0 to about 9.0%. In this regard, it is possible to form the fifth high elastically stretchable region 35 with a plurality of depression 39 and the distance spaces 40 arranged alternately in the circumferential direction of the rear peripheral portion 19 as in the first through fourth high elastically stretchable regions 31, 32, 33, 34, and also it is possible to form these first through fourth high elastically stretchable regions 31, 32, 33, 34 to be relatively thin as a whole as in the fifth high elastically stretchable region 35. However, as will be described in more detail later, the fifth high elastically stretchable region 35 serves to cover a region under the wearer's nose and therefore the fifth high elastically stretchable region 35 preferably does not have a bellows-like pattern composed of a plurality of the depressions 39 and the flat portions 40 as in the first through fourth high elastically stretchable regions 31, 32, 33, 34 from the viewpoint of the appearance.

Figure 7:
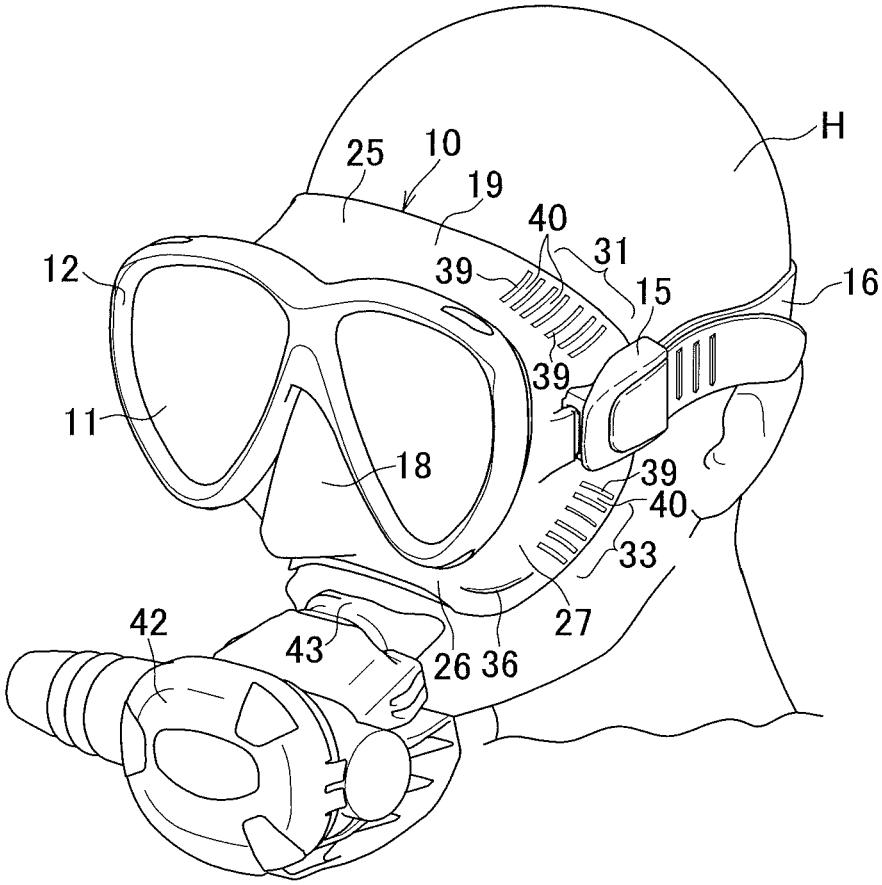
FIG. 7 is a perspective view of the swimming mask worn by the wearer.

Referring to FIG. 7, with the swimming mask 10 put on the facial surface of a wearer H, the first and second high elastically stretchable regions 31, 32 are positioned to face protruding regions of frontal bone immediately above eyebrows of the wearer H. The third and fourth high elastically stretchable regions 33, 34 are positioned to face cheek bones of the wearer H. Lateral protruding regions of the frontal bone and the cheek bones are more protrusive than the remaining region in the facial configuration of the wearer H and the first through fourth high elastically stretchable regions 31, 32, 33, 34 well elastically stretch and contract in the circumferential direction of the rear peripheral portion 19 conforming to such protrusive regions so that the rear peripheral portion 19 as a whole may be kept in close contact with the facial surface of the wearer H. Therefore, the rear peripheral portion 19 is unlikely to be partially separated from these protruding regions and water should not flow into the swimming mask 10. In consideration of the fact that the wearer's skin is relatively thin on the cheek bones and the lateral protruding regions of the frontal bone, if the elastic skirt 13 is formed of the material having a relatively poor stretchability and a relatively high stiffness, the wearer's skin may be pulled rearward and uncomfortably irritated when the head strap is put about the wearer's head. In this regard, the first through fourth high elastically stretchable regions 31, 32, 33, 34 can be smoothly stretched and contracted under the effect of a plurality of the depressions 39 and a stiffness thereof is sufficiently low as a whole to avoid the uncomfortable irritation to the wearer's skin. In this way, it is possible to inhibit the possibility that portions of the wearer's face in which the skin is relatively thin might be pulled rearward together with the elastic skirt 13, and thereby to alleviate the irritation to the skin of the wearer H.

During diving, the mask wearer often holds a mouthpiece 43 of a regulator 42 in the mouth. In such situation, the upper lip is uplifted by the mouthpiece held in the mouth and correspondingly the lower covering region 26 of the rear peripheral portion 19 is curved. The fifth high elastically stretchable region 35 is formed so as to face a midsection of the lower covering region 26, in other words, so as to face a region below the nose of the wearer H, and therefore this fifth high elastically stretchable region 35 elastically stretches in the circumferential direction of the rear covering region 19 to come in close contact with the uplifted region below the nose without creating a gap through which water flows into the swimming mask 10 or creating discomfort to the wearer H.

The region of the rear peripheral portion 19 other than the respective high elastically stretchable regions has a required thickness and is stably held in contact with the wearer's facial surface. Particularly, the regions adapted to cover the wearer's forehead and lower cheeks must have a thickness and a stiffness sufficient to prevent displacement of the elastic skirt due to movements of the wearer's forehead and cheeks. The region adapted to cover the lower portions of the cheeks is provided with the protrusions 36 ensuring that the elastic skirt 13 is stably in contact with the cheeks and conforms to movements of the cheeks without being spaced away from the wearer's skin in this region during use of the swimming mask 10.

Though not illustrated, the rear peripheral portion 19 is preferably coated on its inner surface with any cosmetically acceptable coating agent in order to alleviate a sliding friction between the inner surface of the rear peripheral portion 19 and the skin. In an usual swimming mask, the elastic skirt is formed of soft elastic material such as silicone rubber or elastomer and, therefore, the inner surface thereof is apt to stick to the wearer's skin with a low slidability and, as a result, the wearer's skin is apt to be pulled rearward together with the elastic skirt which is pulled rearward in putting on the swimming mask, possibly causing problems such that the wearer's skin might be uncomfortably irritated and/or the outer side edge of the rear peripheral portion might be folded to develop a gap allowing water to flow into the swimming mask. As a countermeasure to such problems, the elastic skirt may be coated on its inner surface, particularly along the outer side edge 19*a* of the rear peripheral portion 19 with coating agent adapted for improvement of sliability relative to the skin to inhibit the tendency that the wearer's skin is pulled rearward together with the elastic skirt. As such coating agent, for example, organic resin powders and/or inorganic filler powders containing therein fine particles of, for example, polyethylene, polycarbonate, acrylic resin, nylon, urethane resin, silicone rubber or acrylic rubber may be used. For further improvement of the slidability of the first through fifth high elastically stretchable regions 31, 32, 33, 34, 35 relative to the skin when these regions stretch and contract, the coating agent is preferably applied to the inner surface of these high elastically stretchable regions. To improve the slidability of the inner Surface of the elastic skirt relative to the skin, in addition to coating the elastic skirt 13 with the coating agent, the elastic skirt may be formed on its inner surface with fine irregularities such as grains and/or the elastic skirt 13 itself may be formed of elastic material having a high slidability relative to the skin.

Figure 8:
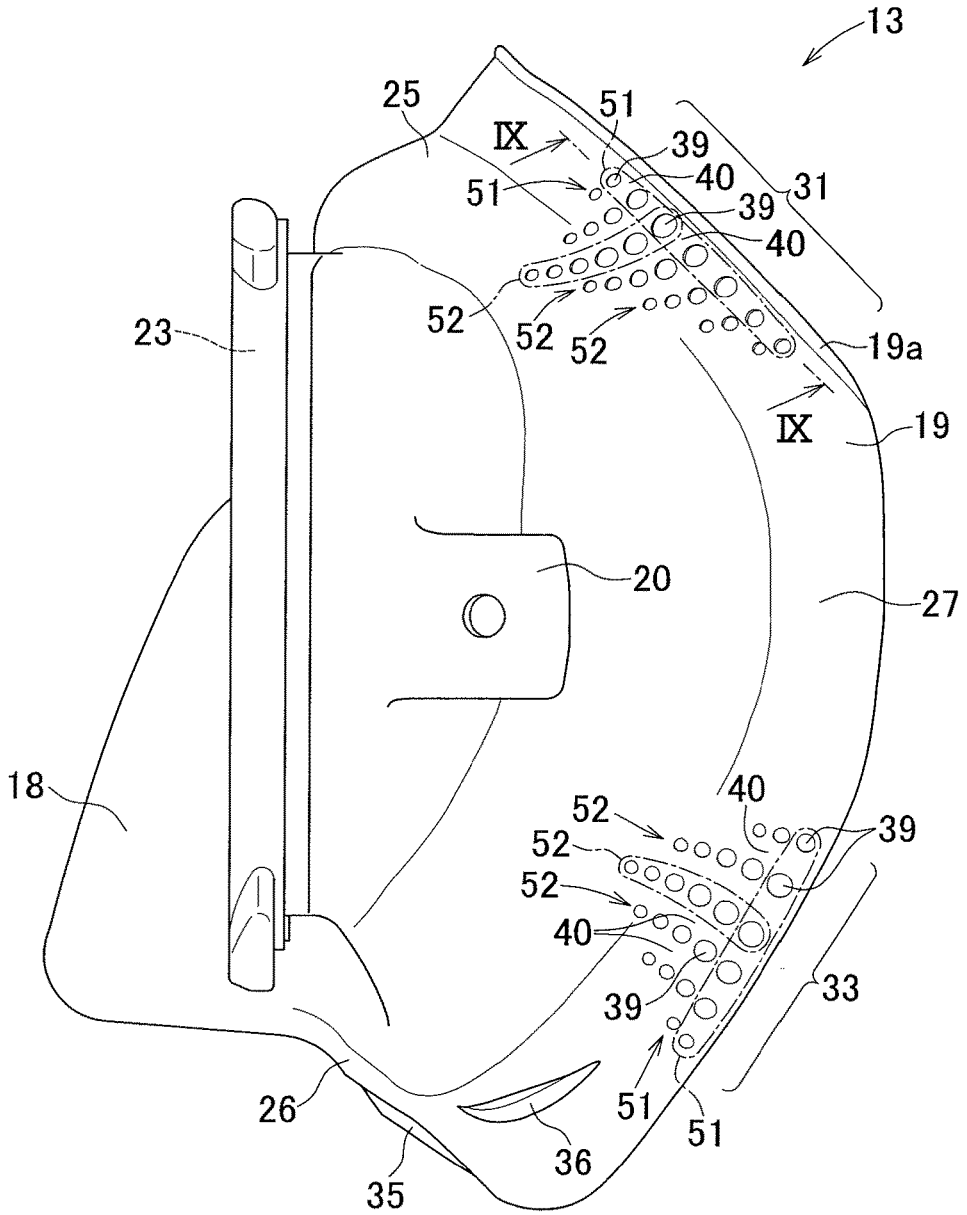
FIG. 8 is a right side view similar to FIG. 3, illustrating the embodiment in FIG. 1.
Figure 9:
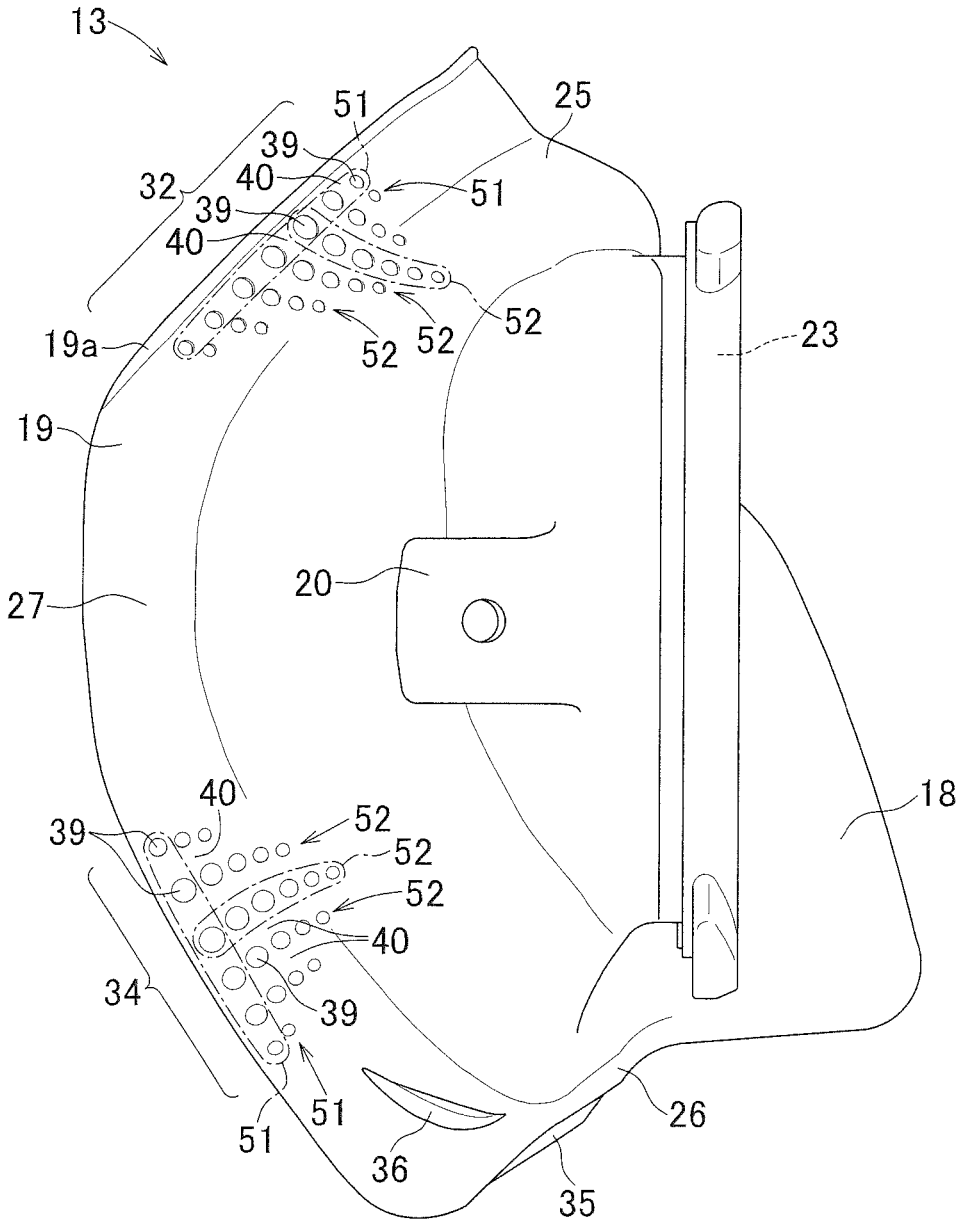
FIG. 9 is a left side view similar to FIG. 4, illustrating the embodiment of FIG. 1.
Figure 10:
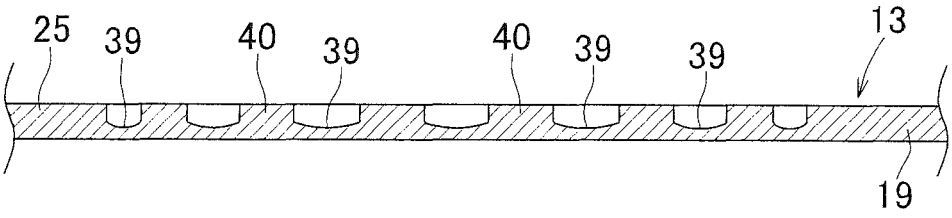
FIG. 10 is a sectional view taken along line IX-IX in FIG. 8.

According to an embodiment illustrated in FIGS. 8, 9, and 10, the first, second, third, and fourth high elastically stretchable regions 31, 32, 33, 34 are formed with a plurality of first rows 51 each including a plurality of dot-like depressions 39 arranged in the circumferential direction of the rear peripheral portion 19 and a plurality of second rows 52 each including a plurality of depressions 39 arranged in the direction intersecting the rear peripheral portion 19. Each pair of the adjacent first rows 51 are spaced apart from each other in the direction intersecting the rear peripheral portion 19 and each pair of the adjacent second rows 52 are spaced apart from each other in the circumferential direction of the rear peripheral portion 19 leaving a flat portion 40 therebetween. In this manner, the first and third high elastically stretchable regions 31, 32, 33, 34 may be formed with the first and second rows 51, 52 each including a plurality of the depressions 39 to ensure that the elastic skirt can smoothly stretch and contract not only in the circumferential direction but also in the direction intersecting the rear peripheral portion 19 conforming to the facial configuration of the wearer and can be kept in close contact with the wearer's skin.

The depressions 39 have respective areas gradually enlarged from the innermost depression 39 to the outermost depression 39 in the direction intersecting the rear peripheral portion 19 and the number of the depressions 39 in the first rows 51 is gradually increased from the innermost first row 51 to the outermost first row 51 and each of the first and third high elastically stretchable regions 31, 33 respectively has a shape which gradually becomes wide rearward. In consequence, the elastic stretchability of these regions 31, 33 is gradually enhanced toward the outer side edge 19*a* of the rear peripheral portion 19 in the circumferential direction as well as in the direction intersecting the rear peripheral portion 19. As a result, these regions 31, 33 can be kept in close contact with the facial surface along the configuration thereof and prevent water from flowing into the swimming mask. In this way, the number, the area and the depth of the depressions 39 in the first and second rows 51, 52 may be varied to achieve a fine adjustment of the elastic stretchability of the first and third high elastically stretchable regions 31, 33. In addition, a plurality of the depressions 39 arranged in dot-pattern functions as a designed decoration and improves appearance of the swimming mask 10.

The constituent members of the swimming mask are not limited to those described in the present description but the other types of material widely used in the relevant technical field may be used without limitation. The terms "first" and "second" used in the description and claims of the present invention are used merely to distinguish the similar elements, similar positions or other similar means.

What is claimed is:

1. A swimming mask having a vertical direction, a transverse direction, a front-back direction and a vertical center line, comprising:

a mask chassis including lenses, a lens frame and an elastic skirt formed of elastic material and extending reward from a periphery of the lens frame and having a rear peripheral portion adapted to be kept in contact with a facial surface of a wearer;

a head strap including opposite distal ends, each opposite distal end connected to a respective connector portion provided on both sides on the mask chassis;

the rear peripheral portion of the elastic skirt includes an upper covering region, a lower covering region, and lateral covering regions;

the upper covering region and the lateral covering regions are formed with high elastically stretchable regions adapted to be more easily stretched in a circumferential direction of the rear peripheral portion than a remaining region of the rear peripheral portion; and first and second high elastically stretchable regions are provided in the upper covering region and are spaced apart from each other so as to be positioned in a portion of the upper covering region, the spaced apart first and second highly elastically stretchable regions respectively positioned between the vertical center line and the respective connector portions of the mask chassis in the upper covering region, and third and fourth high elastically stretchable regions are provided in the lateral covering region and are spaced apart from each other so as to be positioned in a portion of the lateral covering region, the spaced apart third and fourth highly elastically stretchable regions respectively positioned below the respective connector portions in the lateral covering regions; wherein:

each of the first, second, third and fourth high elastically stretchable regions are respectively formed with a plurality of circular-like depressions, the circular-like depressions arranged in first and second rows, the first rows arranged in the circumferential direction of the rear peripheral portion, and the second rows arranged in a direction perpendicular to an outer edge of the rear peripheral portion;

adjacent first rows are spaced apart from each other in the direction perpendicular to an outer edge of the rear peripheral portion and adjacent second rows are spaced apart from each other in the circumferential direction of the rear peripheral portion, leaving a flat portion between each of the circular-like depressions; and the circular-like depressions in each of the second rows increase in one or both of area and depth in the direction perpendicular to the outer side edge of the rear peripheral portion.

2. The swimming mask according to claim 1, wherein the lower covering region includes a fifth high elastically stretchable region lying in a midsection of the lower covering region and having a thickness smaller than of a remaining portion in the lower covering region.

3. The swimming mask according to claim 1, wherein protrusions for stability of the elastic skirt are respectively formed between the third and fourth high elastically stretchable regions.

4. The swimming mask according to claim 1, wherein each of outer ends of the circular-like depressions forming each of the high elastically stretchable regions lie inboard of an outer side edge of the rear peripheral portion.

5. The swimming mask according to claim 1, wherein the circular-like depressions in the second row increase in area.

6. The swimming mask according to claim 5, wherein the circular-like depressions in the second row increase in depth.

7. The swimming mask according to claim 1, wherein the circular-like depressions in the second row increase in depth.

* * * * *